US010492584B2

(12) United States Patent
Yokote et al.

(10) Patent No.: US 10,492,584 B2
(45) Date of Patent: Dec. 3, 2019

(54) MEDIUM STORAGE BOX AND MEDIUM HANDLING DEVICE

(71) Applicant: Oki Electric Industry Co., Ltd., Tokyo (JP)

(72) Inventors: Takamoto Yokote, Tokyo (JP); Masashi Kashiwabuchi, Tokyo (JP); Hiroshi Yokokawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/575,123

(22) PCT Filed: Apr. 27, 2016

(86) PCT No.: PCT/JP2016/063261
§ 371 (c)(1),
(2) Date: Nov. 17, 2017

(87) PCT Pub. No.: WO2016/203855
PCT Pub. Date: Dec. 22, 2016

(65) Prior Publication Data

US 2018/0140068 A1 May 24, 2018

(30) Foreign Application Priority Data

Jun. 18, 2015 (JP) ..... 2015-122517

(51) Int. Cl.
*E05G 1/12* (2006.01)
*B05B 1/20* (2006.01)
(Continued)

(52) U.S. Cl.
CPC ..... *A45C 13/24* (2013.01); *B05B 1/04* (2013.01); *B05B 1/20* (2013.01); *E05G 1/12* (2013.01);
(Continued)

(58) Field of Classification Search
CPC ..... A45C 13/24; A45C 2001/03; A45C 2001/006; A45C 1/12; A45C 2001/003;
(Continued)

(56) References Cited

U.S. PATENT DOCUMENTS 2,026,743 A * 1/1936 Kurtz ..... B05B 1/044 239/594
2,375,297 A * 5/1945 Freeman ..... A62C 3/06 169/68
(Continued)

FOREIGN PATENT DOCUMENTS

JP H07-275744 A 10/1995
JP 2005-182348 A 7/2005
(Continued)

*Primary Examiner* — Lloyd A Gall
(74) *Attorney, Agent, or Firm* — Rabin & Berdo, P.C.

(57) ABSTRACT

A medium storage box includes a guide member and a liquid spraying mechanism. The guide member forms a stacking space for a medium. The liquid spraying mechanism sprays a liquid from a liquid spraying nozzle. The liquid spraying nozzle has a pipe section through which liquid flows, a first liquid spray hole and a second liquid spray hole. The first liquid spray hole sprays liquid in a direction that intersects an extension direction of the pipe section at substantially a right angle. The second liquid spray hole sprays liquid in a direction that is approximately the extension direction of the pipe section.

8 Claims, 9 Drawing Sheets

(51) Int. Cl.

| | |
|---|---|
| ***A45C 13/24*** | (2006.01) |
| ***B05B 1/04*** | (2006.01) |
| ***G08B 15/02*** | (2006.01) |
| ***G07D 11/125*** | (2019.01) |
| ***G07D 11/225*** | (2019.01) |
| *A45C 1/00* | (2006.01) |

(52) U.S. Cl.
CPC ..... *G07D 11/125* (2019.01); *G07D 11/225* (2019.01); *G08B 15/02* (2013.01); *A45C 2001/003* (2013.01)

(58) Field of Classification Search
CPC .. E05G 1/12; E05G 1/14; G08B 15/02; G07D 9/00; G07D 11/225; G07D 11/125; B05B 1/20; B05B 1/04; B05B 1/044; B05B 1/046
USPC ..... 109/20, 25, 29–34
See application file for complete search history.

(56) References Cited

U.S. PATENT DOCUMENTS 2,810,608 A * 10/1957 Biber ..... B05B 1/044 239/592
9,176,017 B2 * 11/2015 Tschantz ..... G01L 7/00
10,260,273 B2 * 4/2019 Yokote ..... G07D 11/125
10,267,081 B2 * 4/2019 Yokote ..... E05G 1/12
2002/0029728 A1 * 3/2002 Walker ..... E05G 1/14 109/25
2004/0007165 A1 * 1/2004 Abe ..... E05G 1/14 109/20
2004/0154500 A1 * 8/2004 Richard ..... E05G 1/005 109/25
2006/0144966 A1 * 7/2006 Schwegler ..... B05B 7/0416 239/554
2009/0235847 A1 * 9/2009 Villiger ..... E05G 1/14 109/25
2012/0175437 A1 * 7/2012 Sloan, Jr. ..... B05B 1/00 239/597
2013/0055932 A1 * 3/2013 Berendes ..... E05G 1/14 109/25
2014/0103147 A1 * 4/2014 Dodson ..... B05B 1/02 239/597
2015/0100480 A1 * 4/2015 Colvin ..... G06Q 20/1085 705/39
2015/0161840 A1 * 6/2015 Nishino ..... B65H 31/24 194/206
2017/0113326 A1 * 4/2017 Nguyen ..... B24C 5/04
2018/0111175 A1 * 4/2018 Becker ..... B08B 9/0936

FOREIGN PATENT DOCUMENTS

JP 2007-014901 A 1/2007
JP 2010-055134 A 3/2010

* cited by examiner

MEDIUM STORAGE BOX AND MEDIUM HANDLING DEVICE

TECHNICAL FIELD

The present invention relates to a medium storage box and a medium handling device, for example, a medium storage box including a liquid spraying mechanism that sprays liquid to stain a medium during an occurrence of criminal activity (an emergency) such as damage or theft, and a medium handling device loaded with the medium storage box.

BACKGROUND ART

Cash handling devices that handle cash are one hitherto known type of a medium handling device that handles a medium. Cash handling devices are given functionality to spray colored liquid at a medium (banknotes) to stain the medium during an occurrence of criminal activity (an emergency), in which the cash handling device has been damaged and the medium (banknotes) stored inside stolen. Note that "stain" means a state in which liquid is adhered to the medium so as to soil the medium. This functionality is realized by providing a liquid spraying mechanism that sprays liquid from a liquid spraying nozzle to a medium storage box stored inside a cash handling device, for example (see, for example, Japanese Patent Application Laid-Open (JP-A) No. 2010-55134).

The medium storage box is a configuration element inside which the medium is stored. The medium storage box is often configured as a unit that is capable of being attached and removed from the cash handling device, so as to enable transportation in a state removed from the cash handling device. The medium storage box is often configured such that the medium is stored in a state stacked in the up-down direction (a stacked-layer state).

If the criminal activity (emergency) described were to occur, the liquid spraying mechanism would stain the medium stored inside the medium storage box, thus placing the medium in a difficult-to-use state. The liquid spraying mechanism thereby prevents stolen medium from being used. Moreover, if the stolen medium were to be used, the liquid spraying mechanism facilitates discovery of the use of stolen medium, facilitates the identification of the person who used the stolen medium, thereby deterring recurrence of the criminal activity (emergency).

SUMMARY OF INVENTION

Technical Problem

In the related medium storage box described in JP-A No. 2010-55134, as explained below, there is the issue that there are some locations where the medium is difficult to stain.

For example, as described below, a liquid spraying mechanism of the related medium storage box is configured such that liquid is sprayed on medium (banknotes) stacked in a stacking space from the side so as to stain the medium (banknotes).

Specifically, the stacking space where medium is stacked is formed inside the related medium storage box. A liquid spraying nozzle of the liquid spraying mechanism of the related medium storage box includes a hollow, elongated pipe section through which liquid flows. Configuration is made in which plural liquid spray holes for spraying liquid are formed in a side portion of the pipe section, and the pipe section is disposed so as to extend along the up-down direction at the side of the stacking space.

In this configuration, when medium (banknotes) stacked in the stacking space is stained, the liquid spraying mechanism of the related medium storage box sprays liquid sideways from the liquid spray holes in the pipe section. The liquid spraying mechanism of the related medium storage box thereby sprays liquid onto the medium (banknotes) from the side.

When this occurs, after medium (banknotes) stacked at positions to the side of the liquid spray holes in the pipe section has been stained, sprayed liquid drips downward under its own weight, thereby staining the medium (banknotes) stacked at positions to the side of the liquid spray holes and the medium (banknotes) stacked below these positions.

However, when this occurs sprayed liquid does not stain the medium (banknotes) stacked at positions above the medium to the side of the liquid spray holes in the pipe section. In particular, some medium storage boxes have a configuration in which a conveyance member that conveys the medium (banknotes) is disposed at a high relative position in the periphery of the stacking space. Medium storage boxes with this configuration need to be designed such that the pipe section of a liquid spraying nozzle does not interfere with the conveyance member. Thus, the pipe section of the liquid spraying nozzle cannot be disposed at a position in the vicinity of the conveyance member in a medium storage box with this configuration. Accordingly, in medium storage boxes with this configuration, configuration is such that the pipe section of the liquid spraying nozzle in the vicinity of the conveyance member is formed shorter than the pipe sections of other liquid spraying nozzles and such that the pipe section of this liquid spraying nozzle is disposed lower down. However, in medium storage boxes with this configuration, the liquid spraying nozzle in the vicinity of the conveyance member does not spray liquid on high relative positions, and in particular it is difficult to stain medium (banknotes) stacked at high relative positions.

Locations where medium is difficult to stain are thus present in the related medium storage box. It has accordingly been desirable to be able to stain all medium stored in the related medium storage box over a wide area, including medium stacked at difficult-to-stain locations.

In consideration of the above circumstances, a principle object of the present invention is to provide a medium storage box able to stain all medium stored therein over a wide area, and a medium handling device loaded with such a medium storage box.

Solution to Problem

To achieve the above object, a first aspect of the present invention is a medium storage box for storing a medium. The medium storage box includes a guide member and a liquid spraying mechanism. The guide member forms a stacking space for the medium. The liquid spraying mechanism sprays a liquid from a liquid spraying nozzle. The liquid spraying nozzle has a pipe section through which the liquid flows, a first liquid spray hole that sprays the liquid in a direction intersecting an extension direction of the pipe section at substantially a right angle, and a second liquid spray hole that sprays the liquid in a direction that is approximately the extension direction of the pipe section.

The liquid spraying mechanism of the medium storage box sprays liquid out from the liquid spraying nozzle. When this occurs, the liquid spraying mechanism of the medium storage box sprays liquid from the first liquid spray hole in a direction intersecting the extension direction of the pipe section at substantially a right angle, and sprays liquid from second liquid spray hole in a direction that is approximately the extension direction of the pipe section. The medium storage box is thereby able to stain all stored medium over a wide area.

A second aspect of the present invention is a medium handling device for handling a medium. The medium handling device includes the medium storage box according to the first aspect of the present invention and a conveyance mechanism that conveys a medium fed out from the medium storage box to a desired location.

Advantageous Effects of Invention

The present invention enables all stored medium to be stained over a wide area.

DESCRIPTION OF EMBODIMENTS

Figure 1:
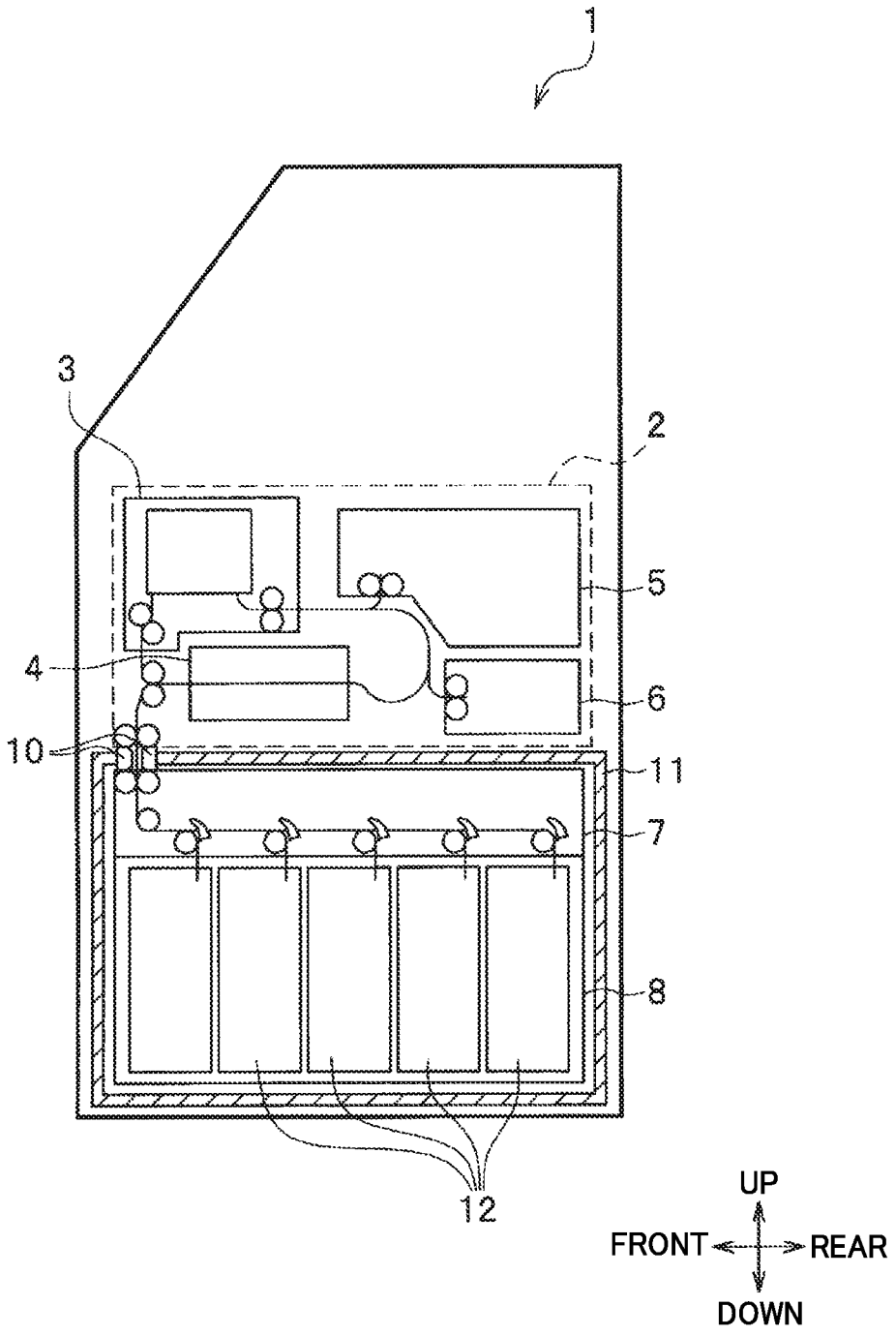
FIG. 1 is a diagram schematically illustrating configuration of a cash handling device loaded with a medium storage boxes including a liquid spraying mechanism according to a first exemplary embodiment.

Detailed explanation follows regarding embodiments for implementing the present invention (referred to below as "present exemplary embodiments"), with reference to the drawings. Note that the drawings are merely schematic illustrations to enable sufficient understanding of the present invention. Thus, the present invention is not limited to the illustrated examples. In each of the drawings, common configuration elements and similar configuration elements are appended with the same reference numerals, and duplicate explanation thereof is omitted.

First Exemplary Embodiment

Configuration of Medium Handling Device Applied with Liquid Spraying Mechanisms

Explanation follows regarding configuration of a medium handling device 1 loaded with medium storage boxes 12 each applied with a liquid spraying mechanism 9 according to a first exemplary embodiment, with reference to FIG. 1. FIG. 1 is a diagram schematically illustrating configuration of a medium handling device 1 loaded with the medium storage boxes 12 provided with liquid spraying mechanisms 9.

Note that explanation follows envisaging a case in which the medium handling device 1 in which the liquid spraying mechanisms 9 are applied is a cash handling device, the medium is banknotes, and the liquid is ink. The liquid sprayed by the liquid spraying mechanisms 9 is hereafter referred to as "ink". The cash handling device 1 may be an automatic teller machine (ATM) or a cash dispenser (CD), for example.

As illustrated in FIG. 1, the cash handling device 1 includes a customer interface 3, a classification section 4, a temporary holding section 5, a reject box 6, a sorting conveyance section 7, and the medium storage boxes 12.

The customer interface 3 is a configuration element that takes in medium (banknotes) to the device interior and discharges the medium to the device exterior.

The classification section 4 is a configuration element that classifies the denomination, authenticity, and so on of the medium.

The temporary holding section 5 is a part that temporarily holds the medium.

The reject box 6 is a storage box that stores non-reusable medium.

The sorting conveyance section 7 is a mechanism that sorts and conveys the medium to a desired medium storage box 12.

The medium storage boxes 12 are storage boxes that store reusable medium. The medium storage boxes 12 are configured as units capable of being installed in and removed from the cash handling device 1.

The cash handling device 1 also includes a non-illustrated damage detector and a non-illustrated controller. In cases in which the cash handling device 1 has been damaged, the non-illustrated damage detector detects the damage, and outputs a damage detection signal to the controller of the cash handling device 1. In response to this, the controller of the cash handling device 1 outputs an ink-spray command to a non-illustrated liquid spray controller, described later, provided inside each liquid spraying mechanism 9.

The main functions of the cash handling device 1 are divided between an upper unit 2 that takes in the medium to the device interior and discharges the medium to the device exterior, and a lower unit 8 that houses the medium storage boxes 12. The customer interface 3, the classification section 4, the temporary holding section 5, and the reject box 6 are provided in the upper unit 2. The sorting conveyance section 7 and the medium storage boxes 12 are provided in the lower unit 8.

A handover guide 10 is provided between the upper unit 2 and the lower unit 8. The handover guide 10 is a configuration element that guides the handover of medium between the upper unit 2 and the lower unit 8.

In this configuration of the cash handling device 1, the periphery of the medium storage boxes 12 is covered by a sturdy safe 11 so as to prevent illicit activity involving the medium storage boxes 12. However, there is still a possibility of the cash handling device 1 being damaged and the medium storage boxes 12 being stolen. The medium storage boxes 12 are therefore each provided with the liquid spraying mechanism 9 (see FIG. 3).

The liquid spraying mechanism 9 is a mechanism that sprays ink onto the medium (banknotes) stored inside the respective medium storage box 12 so as to stain the medium when the occurrence of criminal activity (emergency), such as the cash handling device 1 being damaged, is detected. When an emergency has occurred, the liquid spraying mechanism 9 stains the medium so as to place the medium in a difficult-to-use state. The liquid spraying mechanism 9 thereby prevents stolen medium from being used. Moreover, if the stolen medium were to be used, the liquid spraying mechanism 9 facilitates discovery of the use of stolen medium, facilitates the identification of the person who used the stolen medium, thereby deterring recurrence of the criminal activity (emergency).

Configuration of Medium Storage Boxes Including Liquid Spraying Mechanisms

Figure 2:
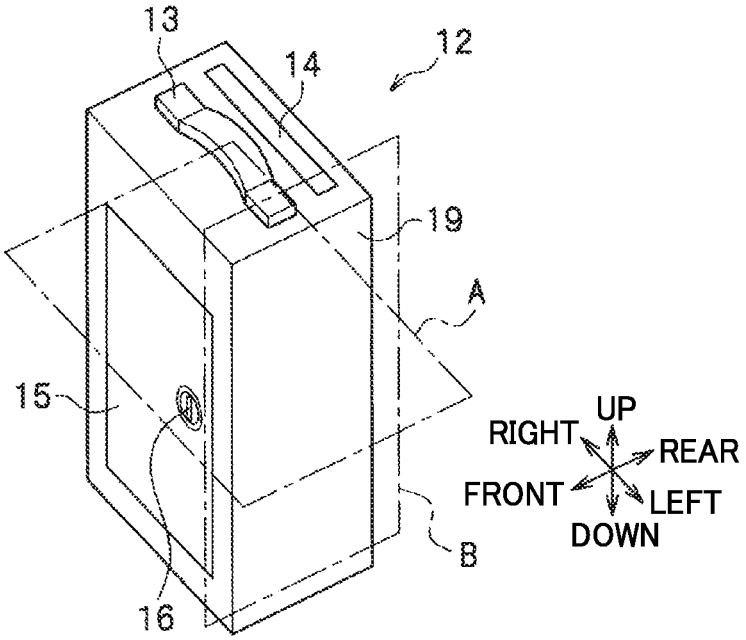
FIG. 2 is a diagram illustrating configuration of a medium storage box including a liquid spraying mechanism according to the first exemplary embodiment.

Explanation follows regarding the configuration of the medium storage boxes 12 each including the liquid spraying mechanism 9 according to the first exemplary embodiment, with reference to FIG. 2. FIG. 2 is a diagram illustrating configuration of a medium storage box 12 including the liquid spraying mechanism 9. FIG. 2 illustrates configuration of a front-face side of the medium storage box 12, as viewed obliquely from an upper left direction.

As illustrated in FIG. 2, each medium storage box 12 includes a handle 13, a door 15, and a lock 16.

The handle 13 is a configuration element that is gripped by a person during transportation.

The door 15 is a mechanism that selectively places an interior space in an open state or a closed state.

The lock 16 is a mechanism that immobilizes the door 15.

A medium through-port 14 is formed in the vicinity of the handle 13 on a top plate of the medium storage box 12. The medium through-port 14 is an opening for taking in the medium to the storage box interior and discharging the medium to the storage box exterior.

An outer profile of the medium storage box 12 is substantially cuboid in shape. The medium storage box 12 is configured so as to store multiple sheets of rectangular shaped medium (banknotes) in a state stacked in the up-down direction (a stacked-layer state) in the space behind the door 15.

The medium storage box 12 includes the non-illustrated liquid spray controller and a non-illustrated pressurizing mechanism. The non-illustrated liquid spray controller actuates the pressurizing mechanism on receiving an ink-spray command from the controller of the cash handling device 1. The non-illustrated pressurizing mechanism pressurizes ink stored in liquid tanks 21 (see FIG. 3), described below, and feeds ink from the liquid tanks 21 to pipes 22 (see FIG. 3), described below.

Schematic Configuration of Liquid Spraying Mechanism

Figure 3:
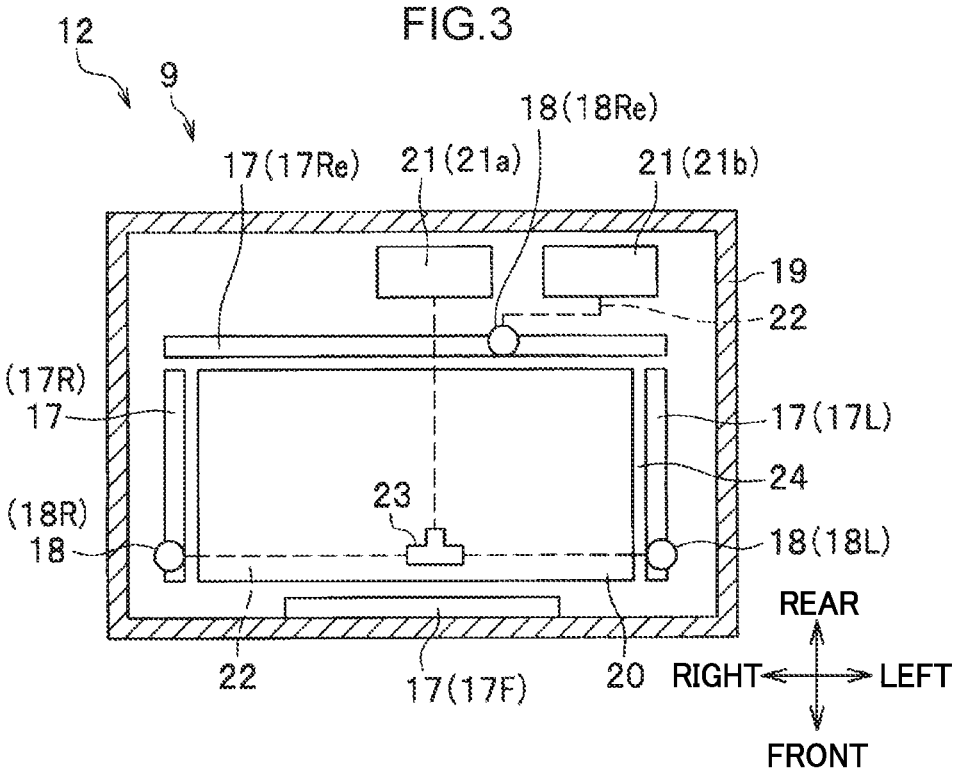
FIG. 3 is a diagram schematically illustrating configuration of a liquid spraying mechanism according to the first exemplary embodiment.
Figure 4:
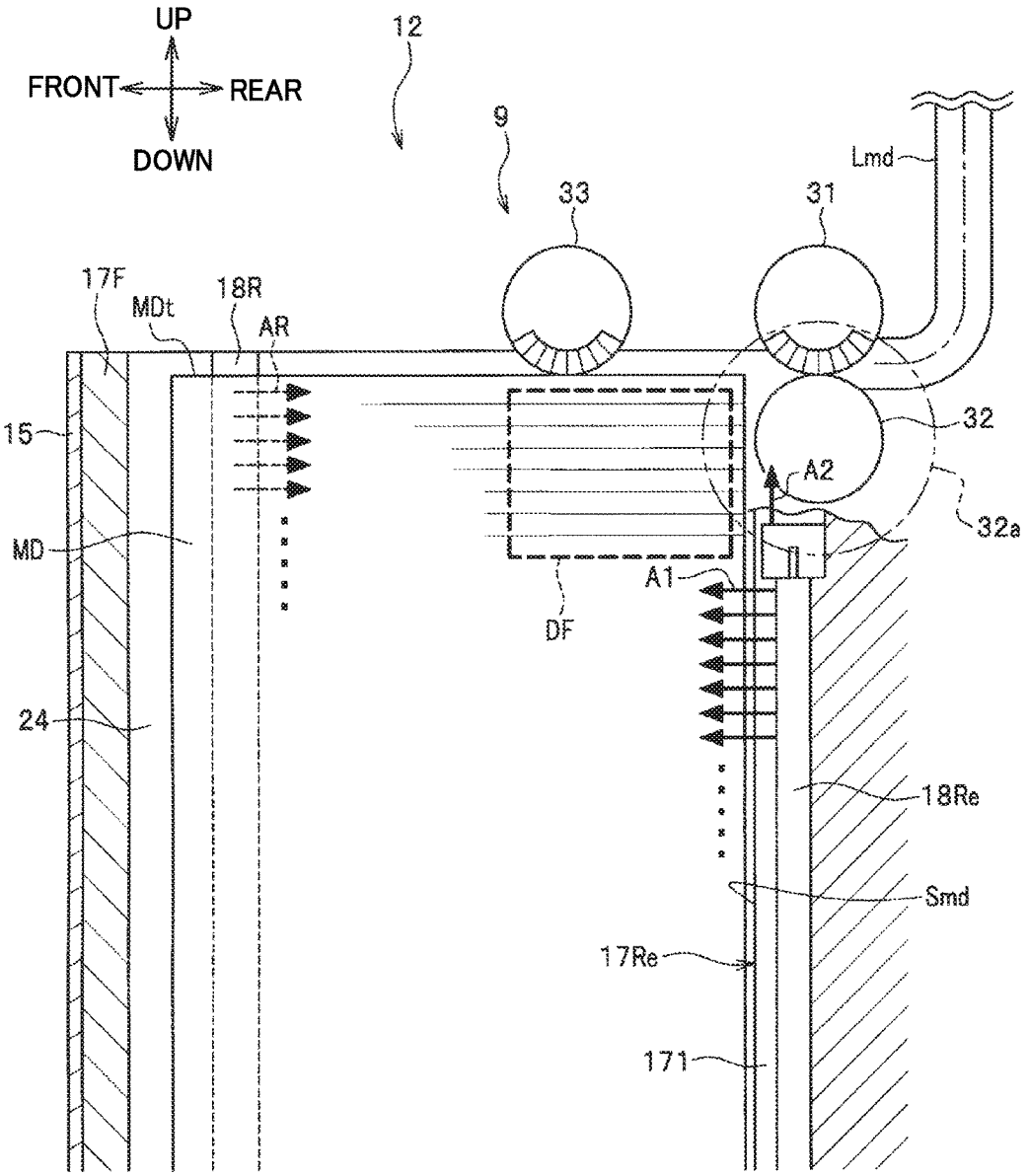
FIG. 4 is a diagram schematically illustrating configuration of a liquid spraying mechanism according to the first exemplary embodiment.

Explanation follows regarding the schematic configuration of the liquid spraying mechanism 9, with reference to FIG. 3 and FIG. 4. FIG. 3 and FIG. 4 are diagrams schematically illustrating configuration of the liquid spraying mechanism 9. FIG. 3 illustrates configuration in a cross-section of the medium storage box 12 taken along plane A illustrated in FIG. 2, as viewed from above. FIG. 4 illustrates configuration in a partial cross-section of the medium storage box 12 taken along plane B illustrated in FIG. 2, as viewed from the left.

Note that, when the explanation distinguishes between configuration elements disposed on the front, rear, left, and right from out of plural of the same configuration elements, "F" is appended to the reference numeral of the configuration element disposed at the front, "Re" is appended to the reference numeral of the configuration element disposed at the rear, "R" is appended to the reference numeral of the configuration element disposed on the right, and "L" is appended to the reference numeral of the configuration element disposed on the left.

As illustrated in FIG. 3, each medium storage box 12 includes guide members 17, liquid spraying nozzles 18, a stage 20, the liquid tanks (ink tanks) 21, the pipes 22, and a liquid junction member 23, at the interior of casing 19.

The guide members 17 are members that abut side edges of each medium stacked on an upper face of the stage 20.

The liquid spraying nozzles 18 are nozzles that spray ink.

The stage 20 is a member having an upper face upon which the medium is stacked.

The liquid tanks (ink tanks) 21 are storage sections in which ink is pre-stored.

The pipes 22 are liquid delivery members through which ink flows for delivery to the respective sections.

The liquid junction member 23 is a member that splits the direction of ink flow.

As viewed from above, a cross-section profile of the casing 19 of the medium storage box 12 has a rectangular shape with its longitudinal direction along the left-right direction and its transverse direction along the front-rear direction.

The stage 20 is disposed inside the medium storage box 12. As viewed from above, the shape of the stage 20 has a rectangular shape with its longitudinal direction along the left-right direction and its transverse direction along the front-rear direction. The upper face of the stage 20 is formed in a flat face shape, and the medium is stacked thereon. The stage 20 is configured so as to be capable of being moved in the up-down direction by a non-illustrated drive means, and the stage 20 is lowered as the medium is stacked on the upper face of the stage 20.

Four of the guide members 17 are disposed in the periphery of the stage 20.

Specifically, a guide member 17F is disposed in front of the stage 20, a guide member 17Re is disposed to the rear of the stage 20, a guide member 17R is disposed on the right of the stage 20, and a guide member 17L is disposed on the left of the stage 20.

Accordingly, the guide members 17F, 17Re face longitudinal edges of the stage 20 (namely, longitudinal edges of the medium stacked on the upper face of the stage 20). Conversely, the guide members 17R, 17L face transverse edges of the stage 20 (namely, transverse edges of the medium stacked on the upper face of the stage 20).

An inner wall face of each guide member 17 that faces the stage 20 is formed in a flat face shape. The inner wall faces abut the side edges of the medium when the medium is stacked on the upper face of the stage 20, and function as medium guide faces that arrange the medium. The inner wall face (medium guide face) of each guide member 17 is disposed so as to extend along the up-down direction (vertical direction).

Of the four guide members 17F, 17Re, 17R, and 17L, the rear guide member 17Re is fixed and installed at a predetermined position inside the casing 19. The guide member 17Re thus functions as a reference member for stacking the medium at a predetermined position in the front-rear direction when stacking the medium onto the upper face of the stage 20.

The other guide members 17F, 17R, and 17L are each configured capable of moving in a direction toward, and a direction away from, the respective facing side edge of the stage 20. The medium storage box 12 is configured such that the medium is stacked in a space 24 surrounded by the four guide members 17F, 17Re, 17R, and 17L. The space 24 is referred to below as the "stacking space 24". The stacking space 24 is largest when the guide members 17F, 17R, and 17L have been moved furthest toward the outside (when moved in directions away from the side edges of the stage 20).

Note that the front guide member 17F is provided at a back side of the door 15 (see FIG. 2). The door 15 may be configured such that the door 15 itself serves as the front guide member 17F. The door 15 may also be configured including a bill stopper.

Three or more of the liquid spraying nozzles 18 are provided in the periphery of the stage 20 so as to face at least three side edges of the medium stacked on the upper face of the stage 20, with a ratio of 1 to 1, or n to 1 (where n is an integer of two or more). Explanation follows in which three of the liquid spraying nozzles 18 are disposed in the periphery of the stage 20 so as to extend along the up-down direction. Specifically, explanation follows in which a liquid spraying nozzle 18Re is disposed to the rear of the stage 20, a liquid spraying nozzle 18R is disposed on the right of the stage 20, and a liquid spraying nozzle 18L is disposed on the left of the stage 20.

Thus, the liquid spraying nozzle 18Re faces a longitudinal edge of the stage 20 (namely, a longitudinal edge of the medium stacked on the upper face of the stage 20). The liquid spraying nozzles 18R, 18L face the transverse edges of the stage 20 (namely, the transverse edges of the medium stacked on the upper face of the stage 20). In the example illustrated in FIG. 3, there are one of each of the liquid spraying nozzles 18Re, 18R, and 18L; however, modification may be made such that there are respectively plural of each. Each liquid spraying nozzle 18 may be configured from either a metal material or a resin material.

The liquid spraying nozzle 18Re of the present exemplary embodiment is disposed at a position slightly to the left of a center of the longitudinal edge of the stage 20 (namely, the longitudinal edge of the medium stacked on the upper face of the stage 20). Non-illustrated liquid spray holes in the liquid spraying nozzle 18Re are disposed in a state inclined at a predetermined angle with respect to the longitudinal edge, such that ink is sprayed from this position toward the center of the longitudinal edge of the stage 20.

The liquid spraying nozzles 18R, 18L are disposed, with respect to centers of the transverse edges of the stage 20, at positions in a direction heading away from the longitudinal edge of the stage 20 facing the liquid spraying nozzle 18Re. Non-illustrated liquid spray holes in the liquid spraying nozzles 18R, 18L are disposed in a state inclined at a predetermined angle with respect to the transverse edges, such that ink is sprayed from these positions toward the longitudinal edge of the stage 20.

Each liquid spraying nozzle 18 includes plural liquid spray holes that spray ink. The liquid spray holes in each of the respective liquid spraying nozzles 18 are disposed collectively extending along the up-down direction (height direction) in the stacking space 24, so as to face media stacked inside the stacking space 24 from an uppermost layer to a lowermost layer thereof. The liquid spraying nozzles 18 spray ink fed out from the liquid tanks 21 through the liquid spray holes toward the medium when an emergency has occurred.

In the first exemplary embodiment, two liquid tanks 21 are disposed to the rear of the guide member 17Re. Reference is made to a "liquid tank 21*a*" and a "liquid tank 21*b*" when distinguishing between each liquid tank 21 below.

The pipes 22 couple the liquid tank 21*a* and the liquid spraying nozzles 18R, 18L together through the liquid junction member 23. The pipes 22 also couple the liquid tank 21*b* and the liquid spraying nozzle 18Re together. The pipes 22 may be configured from either a metal material or a resin material.

The respective liquid tanks 21*a*, 21*b* feed out ink to the pipes 22 when an emergency has occurred. The fed-out ink flows through the pipes 22. When this occurs, the liquid junction member 23 splits the flow direction of ink fed out from the liquid tank 21*a* toward the right liquid spraying nozzle 18R, and toward the left liquid spraying nozzle 18L.

The liquid junction member 23 is provided at a position at which the distances to the two liquid spraying nozzles 18 (the liquid spraying nozzles 18R, 18L in this case) disposed facing each other from one side and another side of the medium are equidistant. Namely, the liquid junction member 23 is disposed at a position at which the distance from the liquid junction member 23 to the liquid spraying nozzle 18R, and the distance from the liquid junction member 23 to the liquid spraying nozzle 18L, are the same.

The liquid spraying mechanism 9 thereby regulates the amount of ink spray such that the liquid spraying nozzle 18 on the one side (the right liquid spraying nozzle 18R in this case) and the liquid spraying nozzle 18 on the other side (the left liquid spraying nozzle 18L in this case), which share ink stored in the liquid tank 21*a*, spray substantially the same amount of ink.

Note that the liquid junction member 23 is preferably disposed in such a position even in cases in which the number of liquid spraying nozzles 18 provided on the one side (right liquid spraying nozzles 18R in this case) and the number of liquid spraying nozzles 18 provided on the other side (left liquid spraying nozzles 18L in this case) are equal and both number two or more.

Since it is desirable that the medium storage box 12 be small and lightweight, it is desirable for the liquid tanks 21*a*, 21*b* to be small. In this medium storage box 12, the amount of ink able to be stored is limited. Accordingly, it is desirable that the medium storage box 12 efficiently stain all medium MD stored in the stacking space 24 over a wide area using a limited amount of ink.

As illustrated in FIG. 4, each medium storage box 12 includes a conveyance path Lmd, a feed roller 31, a gate roller 32, and a pick-up roller 33 at high relative positions to the rear of the stacking space 24.

The conveyance path Lmd is a path on which the medium is conveyed.

The feed roller 31 is a conveyance member that conveys the medium.

The gate roller 32 is a member that prevents two or more sheets of the medium from being fed out and conveyed from the stacking space 24 at the same time.

The pick-up roller 33 is a member that, from out the stacked medium MD stacked in the stacking space 24, feeds the uppermost-stacked medium toward the feed roller 31.

The conveyance path Lmd is formed between the medium through-port 14 (see FIG. 2) and the stacking space 24.

The feed roller 31 is disposed between the stacking space 24 and the conveyance path Lmd. A position of a lower end portion of a peripheral face of the feed roller 31 is set at substantially the same position as the height of the uppermost-stacked medium of the stacked medium MD.

The gate roller 32 is disposed below the feed roller 31 so as to abut the feed roller 31. Note that a non-illustrated tongue piece roller, which rotates along a trajectory 32*a*, is provided so as to be coaxial with the gate roller 32.

The pick-up roller 33 is disposed so as to abut an upper face MDt of the uppermost-stacked medium.

The right liquid spraying nozzle 18R, the left liquid spraying nozzle 18L (see FIG. 3), and the rear liquid spraying nozzle 18Re are disposed in the periphery of the stacking space 24. Each of the liquid spraying nozzles 18 is formed in an elongated pipe shape.

The right liquid spraying nozzle 18R is disposed along the up-down direction so as to extend across substantially the entire up-down direction area of the stacking space 24. Although not illustrated, the left liquid spraying nozzle 18L is similarly disposed along the up-down direction so as to extend across substantially the entire up-down direction area of the stacking space 24. In contrast, the rear liquid spraying nozzle 18Re is disposed along the up-down direction so as to extend from a position directly below the gate roller 32 to the position of a lower end portion of the stacking space 24, so as to not interfere with the gate roller 32. The liquid spraying mechanism 9 feeds ink to each of the liquid spraying nozzles 18 from the bottom up.

The liquid spraying nozzles 18 are set inside grooves formed in the medium guide faces (inner wall faces) of the guide members 17. For example, the rear liquid spraying nozzle 18Re is configured such that a pipe section 181 (see FIG. 5A), described later, is set inside a groove 171 formed in a medium guide face Smd of the rear guide member 17Re. The medium guide face Smd of the rear guide member 17Re is a face that defines a rear portion of the stacking space 24.

The right liquid spraying nozzle 18R sprays ink in a substantially horizontal direction (see arrows AR). Although not illustrated, the left liquid spraying nozzle 18L similarly sprays ink in a substantially horizontal direction. Note that the directions of spray from the right liquid spraying nozzle 18R and the left liquid spraying nozzle 18L are reversed from each other in the left-right direction.

In contrast thereto, the rear liquid spraying nozzle 18Re sprays ink in a substantially horizontal direction (see arrows A1) and directly upward (see arrow A2). Since the rear liquid spraying nozzle 18Re sprays ink directly upward, ink is also sprayed into a space DF. Note that the "directly upward" is a direction that is approximately the extension direction of the pipe section 181 (see FIG. 5A), described later.

Note that the pipe section 181 of the rear liquid spraying nozzle 18Re in the related medium storage box is configured to spray ink only in a substantially horizontal direction and cannot spray directly upward. In addition, in the related medium storage box, it is not possible to extend the pipe section 181 of the rear liquid spraying nozzle 18Re further upward owing to configuration elements such as the feed roller 31 and the gate roller 32. Accordingly, in the related medium storage box, configuration is such that ink cannot be sprayed into the space DF. In contrast thereto, the medium storage box 12 according to the first exemplary embodiment is configured so as to spray ink into the space DR Thus, in the medium storage box 12 according to the first exemplary embodiment, ink is also able to be applied to and stain medium stacked in the space DF.

Rear Liquid Spraying Nozzle Configuration

Figure 5A:
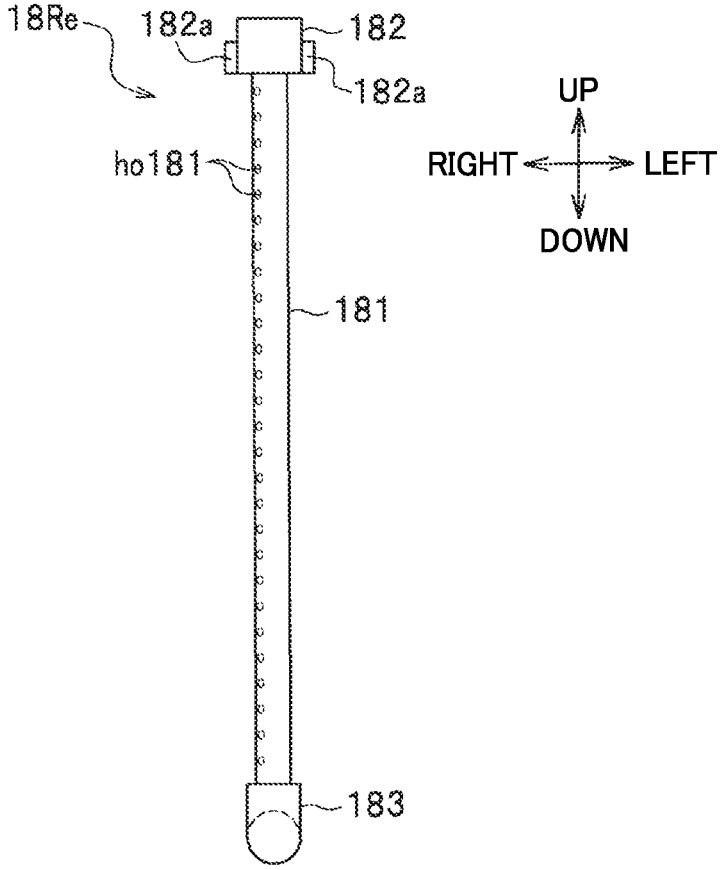
FIG. 5A is a diagram illustrating the overall configuration of a liquid spraying nozzle employed in the first exemplary embodiment.
Figure 5B:
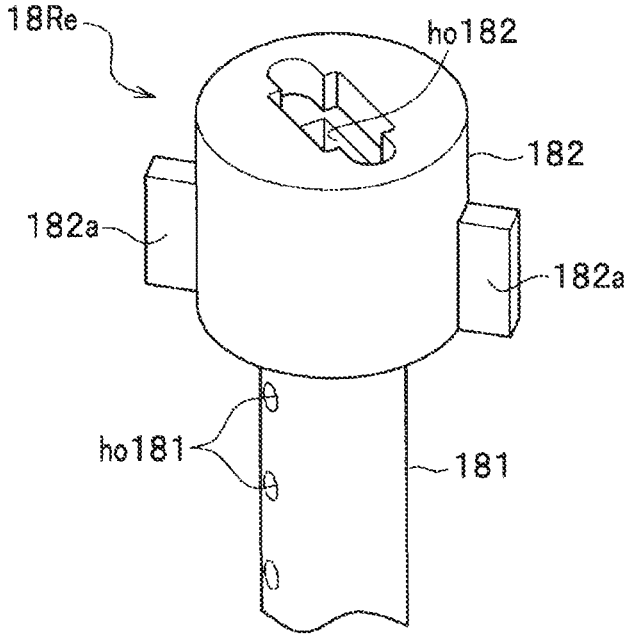
FIG. 5B is a diagram illustrating configuration of relevant portions of a liquid spraying nozzle employed in the first exemplary embodiment.
Figure 6A:
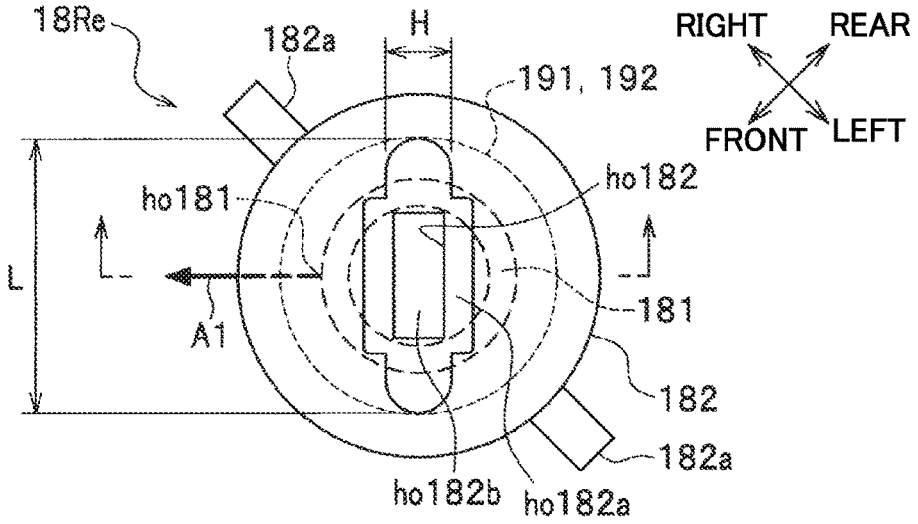
FIG. 6A is a diagram illustrating configuration of an upper end portion of a liquid spraying nozzle employed in the first exemplary embodiment.
Figure 6B:
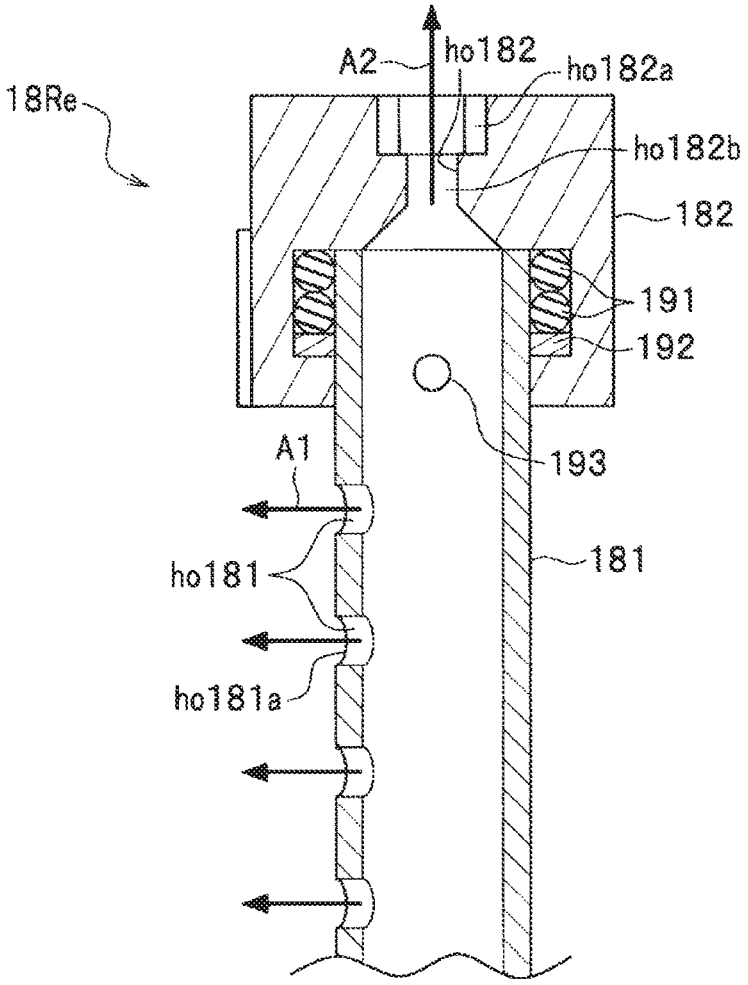
FIG. 6B is a diagram illustrating internal configuration of a liquid spraying nozzle employed in the first exemplary embodiment.

Explanation follows regarding configuration of the rear liquid spraying nozzle 18Re, with reference to FIG. 5A, FIG. 5B, FIG. 6A, and FIG. 6B. FIG. 5A is a diagram illustrating overall configuration of the liquid spraying nozzle 18Re. FIG. 5B is a diagram illustrating configuration of relevant portions of the liquid spraying nozzle 18Re. FIG. 6A is a diagram illustrating configuration of an upper end portion of the liquid spraying nozzle 18Re. FIG. 6B is a diagram illustrating internal configuration of the liquid spraying nozzle 18Re.

As illustrated in FIG. 5A, the rear liquid spraying nozzle 18Re includes the pipe section 181, a cap section 182, and a connection section 183.

The pipe section 181 is a part through which ink flows.

The cap section 182 is a member mounted to an upper end portion of the pipe section 181.

The connection section 183 is a member that connects the pipes 22 (see FIG. 3) and the pipe section 181 together.

The pipe section 181 is formed in an elongated, hollow pipe shape. In the first exemplary embodiment, the pipe section 181 is formed in a circular tube shape. The pipe section 181 is configured from a rust-resistant metal material such as stainless steel.

The cap section 182 has a shape that can be mounted to the upper end portion of the pipe section 181. In the first exemplary embodiment, the cap section 182 is formed into a hollow, circular cylinder shape a few centimeters long. The cap section 182 includes two protrusions 182*a* that protrude in radial directions from a peripheral face of the cap section 182. When the rear liquid spraying nozzle 18Re is set inside the groove 171 of the rear guide member 17Re, the protrusions 182*a* abut an inner wall face of the groove 171 such that the rear liquid spraying nozzle 18Re is immobilized.

The connection section 183 has a shape that can be mounted to a lower end portion of the pipe section 181. In the first exemplary embodiment, the connection section 183 is an elbow fitting formed from a hollow, circular cylinder a few centimeters long that has been bent into substantially an L shape.

The cap section 182 and the connection section 183 may be configured from either a metal material or a resin material. However, since the cap section 182 and the connection section 183 are easier to mold when configured from a resin material, preferably, the cap section 182 and the connection section 183 are configured from a resin material.

Plural liquid spray holes ho181 are formed in a side portion of the pipe section 181. The liquid spray holes ho181 are openings that spray ink in a direction intersecting the extension direction of the pipe section 181 at substantially a right angle (specifically, a substantially horizontal direction).

As illustrated in FIG. 5B, a liquid spray hole ho182 is formed in an end portion of the cap section 182 (a portion positioned along the extension direction of the pipe section 181). The liquid spray hole ho182 is an opening that sprays ink directly upward, this being a direction that is approximately the extension direction of the pipe section 181.

In the following, when distinction is made between the liquid spray holes ho181 and the liquid spray hole ho182, the liquid spray holes ho181 are referred to as "first liquid spray holes ho181" and the liquid spray hole ho182 is referred to as the "second liquid spray hole ho182".

In the example illustrated in FIG. 5B, only one second liquid spray hole ho182 is formed in the end portion of the cap section 182. However, plural of the second liquid spray holes ho182 may be formed in the end portion of the cap section 182.

As illustrated in FIG. 6A, the rear liquid spraying nozzle 18Re is configured such that an opening portion ho182*a* of the second liquid spray hole ho182 is formed in a long, thin slit-shape. In the first exemplary embodiment, the opening portion ho182*a* of the second liquid spray hole ho182 is set such that a length L of the opening ho182*a* is longer than a width H of the opening portion ho182*a*. The second liquid spray hole ho182 is in communication with the inside of the pipe section 181. Note that the opening portion ho182*a* of the second liquid spray hole ho182 may be formed in another shape, such as a circular shape or an elliptical shape.

The second liquid spray hole ho182 is disposed so as to extend along a direction intersecting the direction of ink spray (see arrows A1) from the first liquid spray holes ho181 formed in the pipe section 181 at a desired angle, as viewed from along the extension direction of the pipe section 181.

Note that in the first exemplary embodiment, the extension direction of a side face to the rear of the stacked medium MD stacked in the stacking space 24 (namely, a face defined by the medium guide face Smd of the rear guide member 17Re (see FIG. 4)) is set so as to be substantially parallel to the protrusion direction of the protrusions 182*a*. The direction of ink spray (see arrows A1) from the first liquid spray holes ho181 formed in the pipe section 181 is set so as to be inclined at a predetermined angle with respect to the side face to the rear of the stacked medium MD stacked in the stacking space 24.

FIG. 6B illustrates configuration in a partial cross-section of the rear liquid spraying nozzle 18Re taken along its lengthwise direction, as viewed from the left. As illustrated in FIG. 6B, the rear liquid spraying nozzle 18Re is configured such that the cap section 182 is mounted to the upper end portion of the pipe section 181 through a rubber ring (O-ring) 191 and a press-plate (washer) 192, and such that the cap section 182 is fixed to the pipe section 181 by a retention pin 193.

As illustrated in FIG. 6B, a passage ho182*b* that is narrower than the inner diameter of the pipe section 181 is formed within the second liquid spray hole ho182. The second liquid spray hole ho182 has a shape that widens on progression from the passage ho182*b* to the opening portion ho182*a*.

Through experimentation, it was confirmed that the rear liquid spraying nozzle 18Re efficiently stains medium stacked in the space DF (see FIG. 4) with a limited amount of ink in cases in which the area of the opening portion ho182*a* of the second liquid spray hole ho182 (see FIG. 6B) is set so as to be equal to the total area of all opening portions ho181*a* of the first liquid spray holes ho181 (see FIG. 6B). Thus, the area of the opening portion ho182*a* of the second liquid spray hole ho182 is set so as to be equal to the total area of all of the opening portions ho181*a* of the first liquid spray holes ho181 (note that a given margin of error of a few percent may also be adopted).

In this configuration, the liquid spraying mechanism 9 of the medium storage box 12 according to the first exemplary embodiment sprays ink from the rear liquid spraying nozzle 18Re. When this occurs, the liquid spraying mechanism 9 sprays ink in a substantially horizontal direction from the first liquid spray holes ho181, and sprays ink directly upward from the second liquid spray hole ho182.

Ink sprayed from the first liquid spray holes ho181 stains medium stacked directly beside the first liquid spray holes ho181 (namely, medium stacked at positions slightly below the high relative positions). Then, the ink drips downward under its own weight, and as a result stains medium stacked at positions below these positions.

Ink sprayed from the second liquid spray hole ho182 flows between the medium guide face Smd of the rear guide member 17Re and the stacked medium MD, toward the upper face MDt of the uppermost-stacked medium. Then, after staining medium stacked higher than the second liquid spray hole ho182 (namely, medium stacked at high relative positions (in the space DF)), the ink drips downward under its own weight, and as a result stains medium stacked at positions below these positions.

The medium storage box 12 is thereby able to stain all stored medium MD over a wide area, including medium stacked at high relative positions (in the space DF).

Further, a majority of the ink sprayed from the second liquid spray hole ho182 is adhered to the medium by the time the ink falls to the position of the lowermost layer in the stacking space 24. Thus, the medium storage box 12 is able to efficiently stain all stored medium MD over a wide area using a limited amount of ink.

As described above, the medium storage box 12 according to the first exemplary embodiment enables all stored medium MD to be stained over a wide area.

Second Exemplary Embodiment

A second exemplary embodiment provides a medium storage box 12A that is configured so as to direct the flow of ink sprayed from the second liquid spray hole ho182 of the rear liquid spraying nozzle 18Re.

Figure 7A:
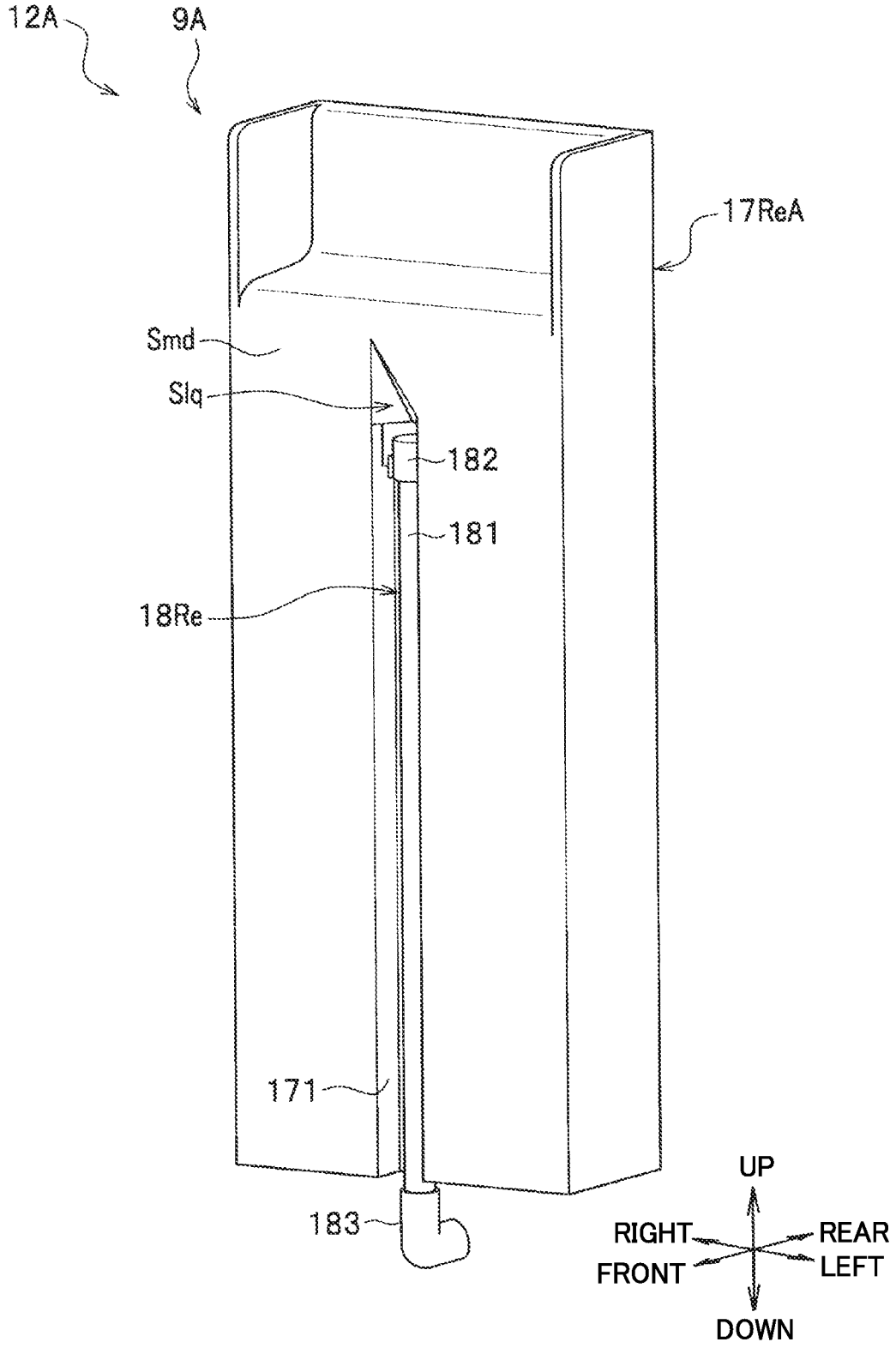
FIG. 7A is a diagram illustrating configuration of a medium storage box according to a second exemplary embodiment.
Figure 7B:
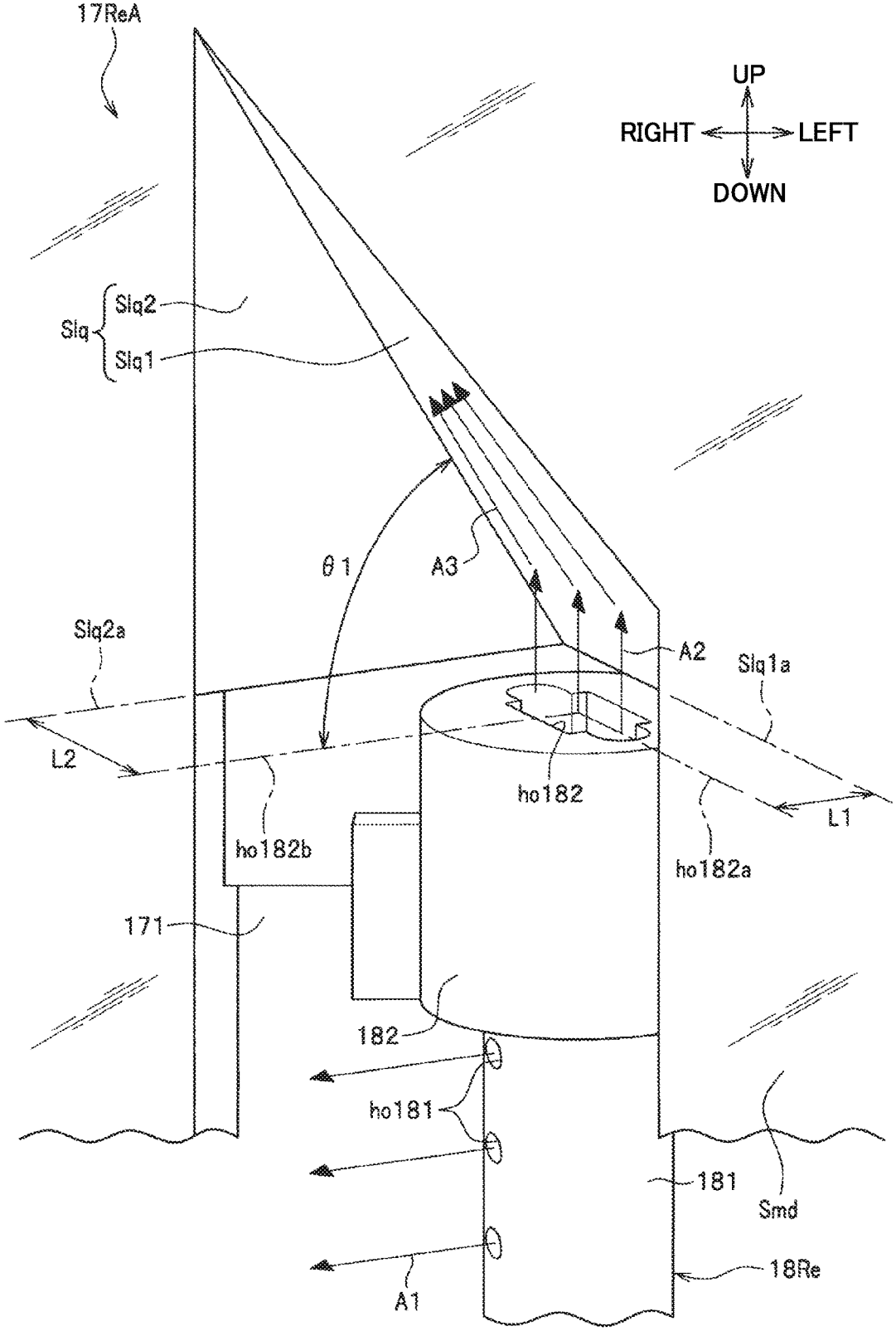
FIG. 7B is a diagram illustrating configuration of a medium storage box according to the second exemplary embodiment.

Explanation follows regarding configuration of the medium storage box 12A according to the second exemplary embodiment, with reference to FIG. 7A and FIG. 7B. FIG. 7A and FIG. 7B are diagrams illustrating configuration of the medium storage box 12A. FIG. 7A illustrates the overall configuration of a rear guide member 17ReA, and FIG. 7B illustrates configuration of relevant portions of the rear guide member 17ReA.

As illustrated in FIG. 7A, the medium storage box 12A according to the second exemplary embodiment differs from the medium storage box 12 according to the first exemplary embodiment (see FIG. 4) in that the rear guide member 17ReA is employed in place of the rear guide member 17Re.

The rear guide member 17ReA differs from the rear guide member 17Re according to the first exemplary embodiment (see FIG. 4) in that liquid directing faces Slq are formed to the groove 171 around the cap section 182.

The liquid directing faces Slq are faces that direct the flow of ink sprayed from the second liquid spray hole ho182 of the rear liquid spraying nozzle 18Re. The liquid directing faces Slq are formed between the gate roller 32 (see FIG. 4) and the second liquid spray hole ho182 of the rear liquid spraying nozzle 18Re.

As illustrated in FIG. 7B, the liquid directing faces Slq include a spray angle altering face Slq1 and a liquid guiding face Slq2 that both face toward the second liquid spray hole.

The spray angle altering face Slq1 is a face that alters the direction of the flow of ink sprayed from the second liquid spray hole ho182 of the rear liquid spraying nozzle 18Re so as to be angled in different direction than the spray direction.

The liquid guiding face Slq2 is a face that guides the flow of sprayed ink.

A spray angle altering face base line Slq1*a* of the spray angle altering face Slq1 runs parallel to an extension direction center line ho182*a* of the second liquid spray hole ho182, and forms an angle θ1 toward the front at a position a length L1 to the rear of the extension direction center line ho182*a*. The angle θ1 is preferably 45° or greater.

A liquid guiding face base line Slq2*a* of the liquid guiding face Slq2 is positioned a length L2 to the left of an intersecting direction center line ho182*b* of the second liquid spray hole ho182, and is formed perpendicularly to the spray angle altering face Slq1.

The medium storage box 12A is able to alter the direction of the flow of ink so as to be angled in a desired direction (see arrows A3) by having ink sprayed in the arrow A2 direction from the second liquid spray hole ho182 of the rear liquid spraying nozzle 18Re strike the liquid directing faces Slq, which have been set at a different angle than the spray direction.

In this configuration, the medium storage box 12A sprays ink from the first liquid spray holes ho181 and the second liquid spray hole ho182.

Similarly to in the first exemplary embodiment, ink sprayed from the first liquid spray holes ho181 stains medium stacked directly beside the first liquid spray holes ho181 (namely, medium stacked at positions slightly below the high relative positions). Then, the ink drips downward under its own weight, and as a result stains medium stacked at positions below these positions.

Ink sprayed from the second liquid spray hole ho182 flows between the medium guide face Smd of the rear guide member 17Re and the stacked medium MD, toward the upper face MDt of the uppermost-stacked medium. Then, after staining medium stacked higher than the second liquid spray hole ho182 (namely, medium stacked at high relative positions (in the space DF)), the ink drips downward under its own weight, and as a result stains medium stacked at positions below these positions. However, when this occurs, since the liquid directing faces Slq alter the direction of the flow of ink, the parabolic paths of the falling ink are more spread out than in the first exemplary embodiment. As a result, the medium storage box 12A is able to apply ink to stacked medium MD in the medium storage box 12 over a wider range.

Figure 8:
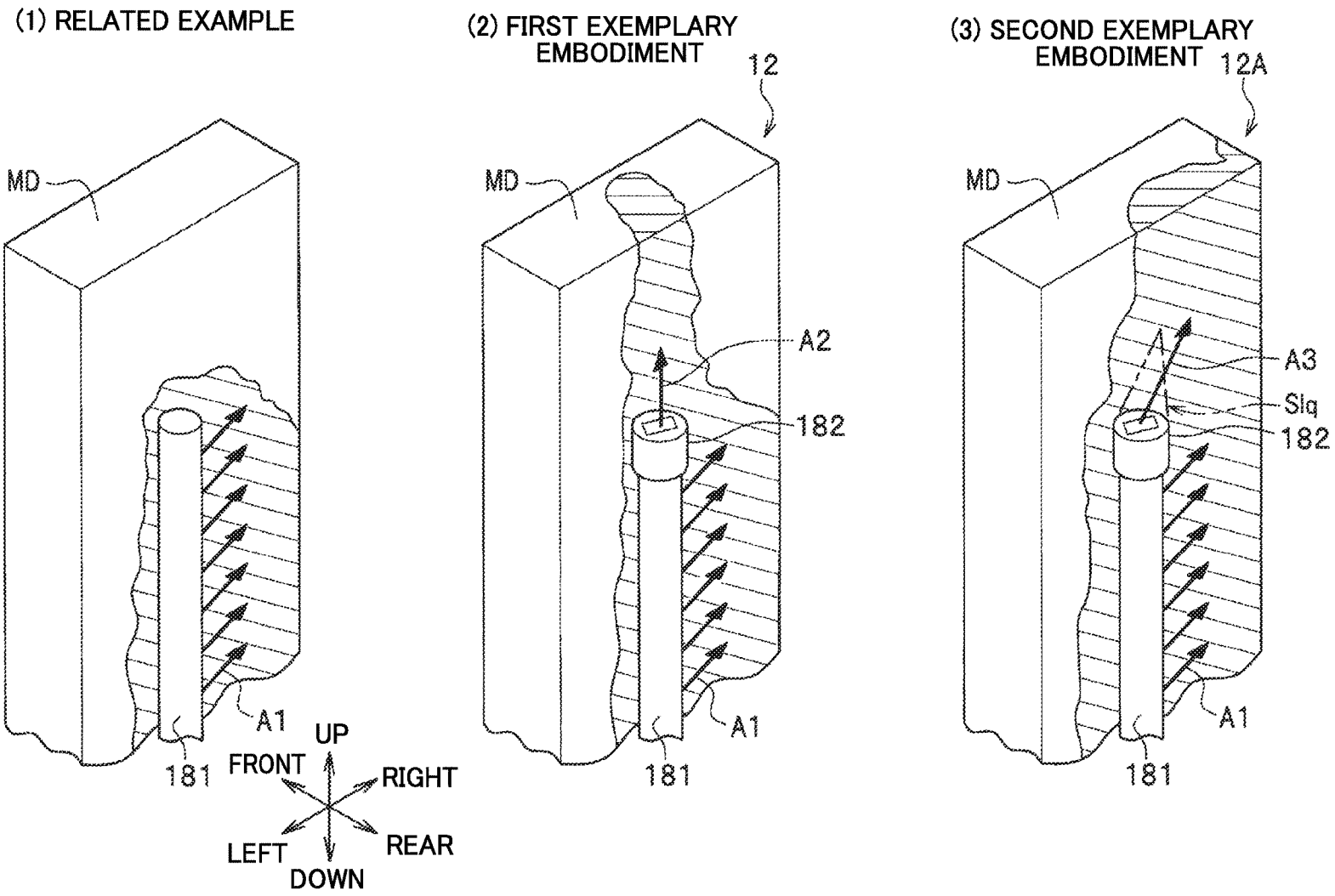
FIG. 8 is a diagram illustrating the advantageous effects of a medium storage box according to the second exemplary embodiment.

FIG. 8 is a diagram illustrating the advantageous effects of the medium storage box 12A. FIG. 8 (1) illustrates a stained area on stacked medium MD in a medium storage box of the related example. FIG. 8 (2) illustrates the stained area on stacked medium MD in the medium storage box 12 according to the first exemplary embodiment. FIG. 8 (3) illustrates the stained area on stacked medium MD in the medium storage box 12A according to the second exemplary embodiment. As illustrated in FIG. 8 (1) to FIG. 8 (3), the medium storage box 12A according to the second exemplary embodiment is able to provide the largest stained area on stacked medium MD. In particular, the medium storage box 12A according to the second exemplary embodiment enables medium stacked at high relative positions to be stained over a wide range, the staining of which is difficult in the medium storage box of the related example.

As described above, the medium storage box 12A according to the second exemplary embodiment enables all stored medium MD to be stained over a wide area more efficiently than in the medium storage box 12 according to the first exemplary embodiment.

Note that the present invention is not limited to the above exemplary embodiments, and various modifications and changes may be implemented within a range not departing from the spirit of the present invention.

For example, the above exemplary embodiments have been explained in detail in order to explain the spirit of the present invention in easily comprehensible terms. Thus, the present invention is not necessarily limited to that including all the configuration explained. Some of the configuration of one exemplary embodiment of the present invention may be added to, or replace, configuration of another exemplary embodiment. Partial configuration may also be omitted from the configuration of an exemplary embodiment of the present invention.

For example, in the above exemplary embodiments, explanation is given envisaging a case in which the medium handling device to which the liquid spraying mechanism is applied is a cash handling device such as an automated teller machine (ATM) or a cash dispenser (CD) used by a financial institution or a distributor. However, the present invention may be utilized not only in cash handling devices such as ATMs or CDs, but in other medium handling devices such as a ticket machine by a transportation provider or a distributor.

In addition, for example, the right liquid spraying nozzle 18R and the left liquid spraying nozzle 18L may be configured so as to include a second liquid spray hole ho182 similarly to the rear liquid spraying nozzle 18Re.

Figure 9:
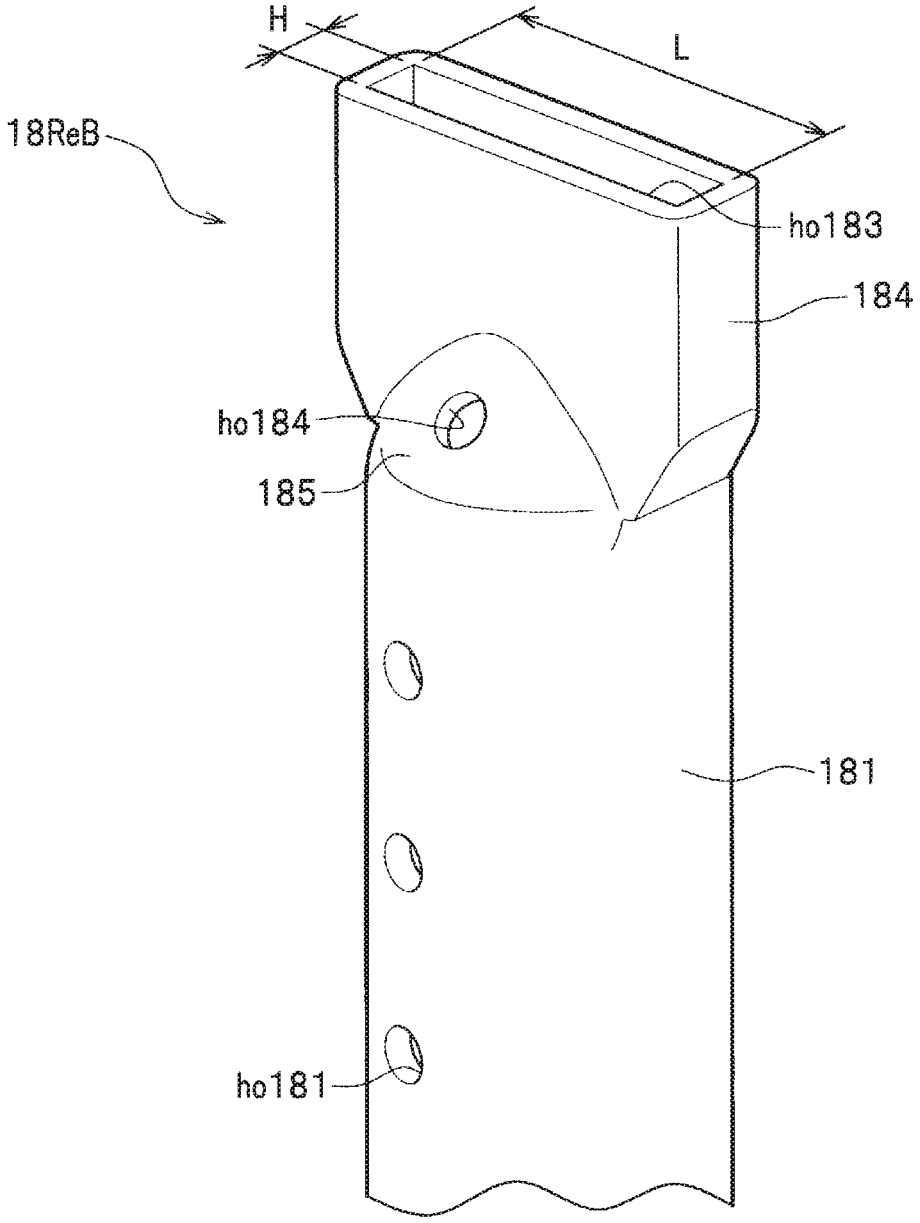
FIG. 9 is a diagram illustrating configuration of a liquid spraying nozzle according to a modified example.

In addition, for example, the rear liquid spraying nozzle 18Re of the first and second exemplary embodiments may be modified as in the liquid spraying nozzle 18ReB illustrated in FIG. 9. FIG. 9 is a diagram illustrating configuration of a liquid spraying nozzle 18ReB according to a modified example.

As illustrated in FIG. 9, the liquid spraying nozzle 18ReB according to the modified example differs from the rear liquid spraying nozzle 18Re according to the first and second exemplary embodiments (see FIG. 5B) in that the cap section 182 is not mounted to the upper end portion of the pipe section 181, and the shape of the upper end portion of the pipe section 181 is modified.

In this modified example, the upper end portion of the pipe section 181 has a shape in which two radial direction sides have been squashed together so as to run parallel to each other. A squashed portion 184 is thereby formed to the upper end portion of the pipe section 181. A long, thin slit-shaped opening is formed in the upper end portion of the squashed portion 184. This opening portion functions as a second liquid spray hole ho183. In the modified example, the length L of second liquid spray hole ho183 is set so as to be longer than the width H of the second liquid spray hole ho183, similarly to the second liquid spray hole ho182 of the first and second exemplary embodiments.

Note that an inclined face 185 is formed to the liquid spraying nozzle 18ReB as a result of forming the squashed portion 184. A second liquid spray hole ho184 is formed in the inclined face 185. This enables a larger amount of ink to be sprayed obliquely upward by the liquid spraying nozzle 18ReB according to the modified example than by the rear liquid spraying nozzle 18Re of the first and second exemplary embodiments.

The second liquid spray hole ho183 and the second liquid spray hole ho184 function similarly to the second liquid spray hole ho182 of the first and second exemplary embodiments.

In addition, the second liquid spray hole ho182 of the rear liquid spraying nozzle 18Re of the first and second exemplary embodiments (see FIG. 6B) may be formed such that on progression from the passage ho182*b* to the opening portion ho182*a*, the direction of ink spray is altered toward an oblique direction. This enables all stored medium MD to be stained over a wide area even more efficiently since the liquid spraying mechanism 9 is able to spray ink in a direction obliquely upward from the second liquid spray hole ho182 of the rear liquid spraying nozzle 18Re. Note that the liquid directing faces Slq explained in the second exemplary embodiment may be omitted in such cases.

The entire disclosure of Japanese Patent Application No. 2015-122517, filed on Jun. 18, 2015, is incorporated by reference herein.

The invention claimed is:

1. A medium storage box for storing a medium, the medium storage box comprising:

a guide member that includes a guide face forming a stacking space for the medium; and a liquid spraying mechanism that sprays a liquid from a liquid spraying nozzle, wherein the liquid spraying nozzle includes:

a pipe section through which the liquid flows, a first liquid spray hole that sprays the liquid in a direction intersecting an extension direction of the pipe section at substantially a right angle, and a second liquid spray hole that sprays the liquid in a direction that is approximately the extension direction of the pipe section, wherein the guide face is formed with a groove in which the pipe section of the liquid spraying nozzle is set, and an inner wall face of the groove near to the second liquid spray hole forms a liquid directing face that directs the direction of liquid sprayed from the second liquid spray hole toward the stacking space.

2. The medium storage box of claim 1, wherein:

the liquid spraying nozzle includes a cap section mounted to an end of the pipe section;

the first liquid spray hole is formed at a side portion of the pipe section; and the second liquid spray hole is formed at an end portion of the cap section.

3. The medium storage box of claim 1, wherein an opening portion of the second liquid spray hole is formed in a long and thin slit-shape.

4. The medium storage box of claim 1, wherein an area of the opening portion of the second liquid spray hole is equal to an area of an opening portion of the first liquid spray hole.

5. The medium storage box of claim 1, wherein the second liquid spray hole is disposed so as to extend along a direction intersecting a direction of liquid spray from the first liquid spray hole at a desired angle, as viewed from along the extension direction of the pipe section.

6. The medium storage box of claim 1, wherein the liquid spraying nozzle is disposed in a periphery of the stacking space such that a direction of liquid spray from the first liquid spray hole is a substantially horizontal direction and such that a direction of liquid spray from the second liquid spray hole is a direction obliquely upward with respect to the horizontal direction.

7. The medium storage box of claim 6, further comprising a roller that is provided in the vicinity of the stacking space and that conveys the medium, wherein:

a liquid spraying nozzle having both the first liquid spray hole and the second liquid spray hole is disposed below the roller in the periphery of the stacking space; and a liquid spraying nozzle having at least the first liquid spray hole is disposed in the periphery of the stacking space.

8. A medium handling device for handling a medium, the medium handling device comprising the medium storage box of claim 1.

* * * * *